US007234774B2

(12) United States Patent
Heidmann et al.

(10) Patent No.: US 7,234,774 B2
(45) **Date of Patent: *Jun. 26, 2007**

(54) SEATING UNIT WITH NOVEL FLEXIBLE SUPPORTS

(75) Inventors: Kurt R. Heidmann, Grand Rapids, MI (US); Renard G. Tubergen, Alto, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/233,848

(22) Filed: Sep. 23, 2005

(65) Prior Publication Data

US 2006/0055220 A1 Mar. 16, 2006

Related U.S. Application Data

(63) Continuation of application No. 10/939,638, filed on Sep. 13, 2004, now Pat. No. 6,957,863, which is a continuation of application No. 10/241,955, filed on Sep. 12, 2002, now Pat. No. 6,869,142.

(51) Int. Cl.
*A47C 1/038* (2006.01)

(52) U.S. Cl. ..... 297/300.1; 297/325; 297/300.6; 297/322; 297/302.1

(58) Field of Classification Search ..... 297/291, 297/296, 300.1, 299, 300.2, 300.6, 316, 317, 297/322, 341, 342, 325 X, 329, 302.1, 300.4; 267/131, 133, 158

See application file for complete search history.

(56) References Cited

U.S. PATENT DOCUMENTS

| | | | | |
|---|---|---|---|---|
| 144,349 A | | 11/1873 | Morrison et al. | |
| 312,775 A | | 2/1885 | Walker | |
| 389,292 A | | 9/1888 | Flohr | |
| 1,513,726 A | | 10/1924 | Lamplugh | |
| 2,316,628 A | | 4/1943 | Schaffner | |
| 2,711,211 A | * | 6/1955 | Tidcombe | 297/291 |
| 2,731,076 A | | 1/1956 | Rowland | |
| 2,803,293 A | | 8/1957 | Rowland | |
| 2,818,911 A | | 1/1958 | Syak | |
| RE24,964 E | | 4/1961 | Eames | |
| 3,271,076 A | | 9/1966 | Smith | |
| 3,332,719 A | | 7/1967 | Flint | |

(Continued)

FOREIGN PATENT DOCUMENTS

| | | |
|---|---|---|
| DE | 19542132 | 11/1997 |

(Continued)

*Primary Examiner*—Laurie K. Cranmer
(74) *Attorney, Agent, or Firm*—Price, Heneveld, Cooper, DeWitt & Litton LLP

(57) ABSTRACT

A seating unit includes a seat, a back, a base, and a motion control having a plurality of flexible supports for operably supporting the seat and back on the base. The flexible supports are movable in a generally fore-to-aft direction but stiff in a generally vertical direction, and further the flexible supports have end sections projecting generally outward from said base for operably engaging the seat and/or back, so that when the flexible supports flex in the fore-to-aft direction, they provide for directed movement of the seat and/or the back. In one form, the flexible supports are integrally molded with the center section of the motion control.

32 Claims, 10 Drawing Sheets

U.S. PATENT DOCUMENTS

| | | | | | |
|---|---|---|---|---|---|
| 3,720,568 | A | | 3/1973 | Rowland | |
| 3,888,473 | A | | 6/1975 | Mandusky et al. | |
| 3,934,932 | A | | 1/1976 | Ekornes | |
| 4,062,590 | A | | 12/1977 | Polsky et al. | |
| 4,247,089 | A | | 1/1981 | Crosby et al. | |
| 4,318,556 | A | | 3/1982 | Rowland | |
| 4,361,357 | A | * | 11/1982 | Pollock | 297/297 |
| 4,415,147 | A | | 11/1983 | Biscoe et al. | |
| 4,478,454 | A | | 10/1984 | Faiks | |
| 4,545,614 | A | | 10/1985 | Abu-Isa et al. | |
| 4,575,150 | A | | 3/1986 | Smith | |
| 4,586,700 | A | | 5/1986 | Crosby | |
| 4,709,962 | A | * | 12/1987 | Steinmann | 297/300.3 |
| 4,715,587 | A | | 12/1987 | Grosby | |
| 4,736,932 | A | | 4/1988 | Haslim | |
| 4,768,244 | A | | 9/1988 | Riedl | |
| 4,815,717 | A | | 3/1989 | Crosby | |
| 4,818,021 | A | | 4/1989 | Roysher | |
| 4,858,992 | A | | 8/1989 | LaSota | |
| 4,935,977 | A | | 6/1990 | Yamada | |
| 4,966,411 | A | * | 10/1990 | Katagiri et al. | 297/300.7 |
| 4,984,846 | A | | 1/1991 | Ekornes | |
| 5,022,709 | A | | 6/1991 | Marchino | |
| 5,024,484 | A | | 6/1991 | Buchacz | |
| 5,046,780 | A | | 9/1991 | Decker et al. | |
| 5,080,318 | A | | 1/1992 | Takamatsu et al. | |
| 5,121,934 | A | | 6/1992 | Decker et al. | |
| 5,251,958 | A | | 10/1993 | Roericht et al. | |
| 5,267,777 | A | | 12/1993 | Valtri | |
| 5,269,497 | A | | 12/1993 | Barth | |
| 5,282,285 | A | | 2/1994 | de Gelis et al. | |
| 5,295,731 | A | * | 3/1994 | Dauphin | 297/440.16 |
| 5,316,371 | A | | 5/1994 | Bishai | |
| 5,356,199 | A | | 10/1994 | Elzenbeck et al. | |
| 5,366,274 | A | | 11/1994 | Roericht et al. | |
| 5,385,389 | A | | 1/1995 | Bishai | |
| 5,472,261 | A | | 12/1995 | Oplenskdal et al. | |
| 5,486,035 | A | | 1/1996 | Koepke et al. | |
| 5,549,358 | A | | 8/1996 | Muller | |
| 5,658,049 | A | | 8/1997 | Adams et al. | |
| 5,782,536 | A | | 7/1998 | Heidmann et al. | |
| 5,871,256 | A | | 2/1999 | Kogai | |
| 5,871,258 | A | | 2/1999 | Battey et al. | |
| 5,931,531 | A | * | 8/1999 | Assmann | 297/316 |
| 5,934,758 | A | | 8/1999 | Ritch et al. | |
| 5,975,634 | A | | 11/1999 | Knoblock et al. | |
| 6,030,039 | A | * | 2/2000 | Essler | 297/273 |
| D423,261 | S | | 4/2000 | Ritch et al. | |
| 6,056,361 | A | | 5/2000 | Cvek | |
| 6,056,367 | A | | 5/2000 | Hsiao | |
| 6,059,368 | A | | 5/2000 | Stumpf et al. | |
| 6,074,013 | A | | 6/2000 | Hsiao | |
| 6,086,153 | A | | 7/2000 | Heidmann et al. | |
| 6,109,694 | A | | 8/2000 | Kurtz | |
| 6,116,694 | A | | 9/2000 | Bullard | |
| 6,116,695 | A | | 9/2000 | Heidmann et al. | |
| 6,134,729 | A | | 10/2000 | Quintile et al. | |
| 6,149,236 | A | | 11/2000 | Brauning | |
| 6,170,915 | B1 | | 1/2001 | Weisz | |
| 6,264,179 | B1 | | 7/2001 | Bullard | |
| 6,523,898 | B1 | | 2/2003 | Ball et al. | |
| 2002/0043867 | A1 | | 4/2002 | Lessmann | |

FOREIGN PATENT DOCUMENTS

| | | | |
|---|---|---|---|
| EP | 0 772 986 A | | 5/1997 |
| WO | WO 82/01760 | * | 5/1982 |
| WO | WO 9313695 | | 7/1993 |
| WO | WO 9816140 | | 4/1998 |
| WO | WO 0022960 | | 4/2000 |
| WO | WO 0176420 | | 10/2001 |

* cited by examiner

FIG. 5A
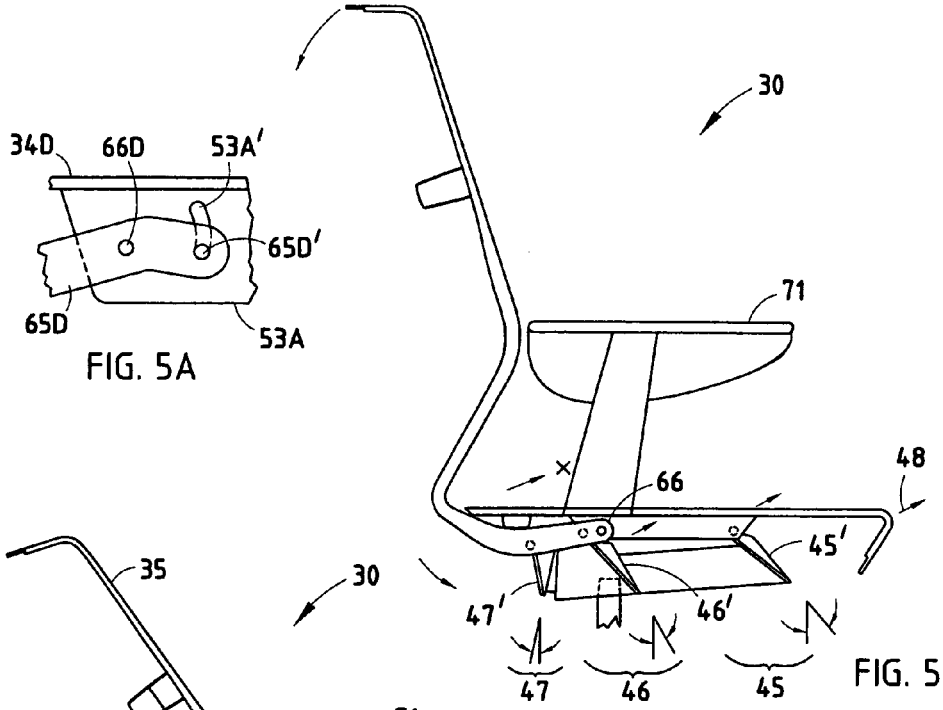
FIG. 5
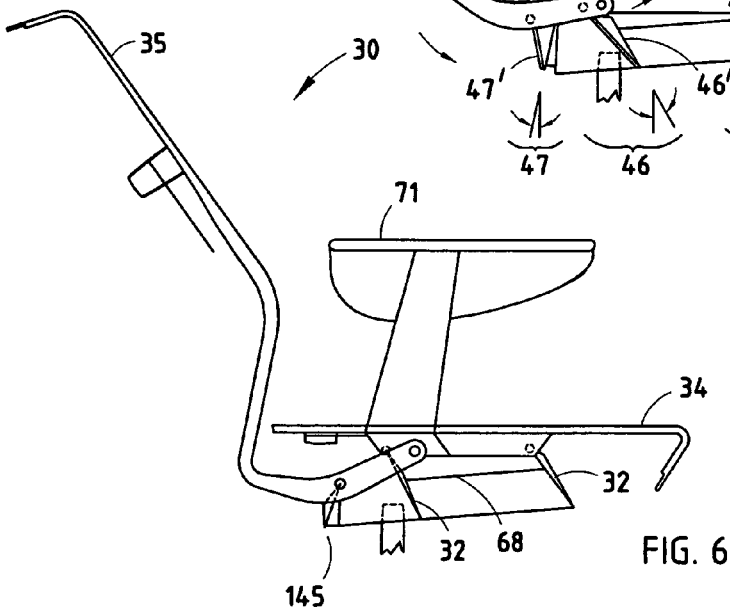
FIG. 6
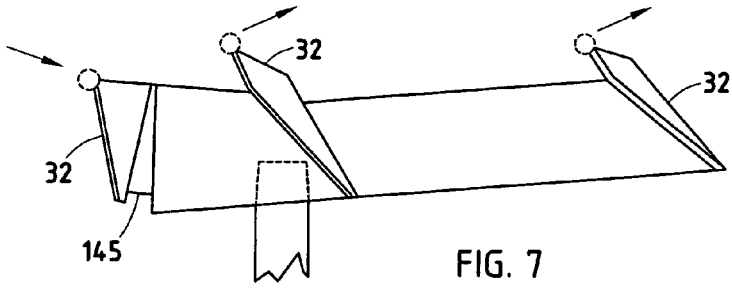
FIG. 7

SEATING UNIT WITH NOVEL FLEXIBLE SUPPORTS

CROSS REFERENCE TO RELATED APPLICATION

This is a continuation of application Ser. No. 10/939,638, filed Sep. 13, 2004 now U.S. Pat. No. 6,957,863, entitled "SEATING UNIT HAVING MOTION CONTROL," which is a continuation of application Ser. No. 10/241,955, filed Sep. 12, 2002 (now U.S. Pat. No. 6,869,142), entitled "SEATING UNIT HAVING MOTION CONTROL."

BACKGROUND OF THE INVENTION

The present invention relates to seating units having motion controls, and more particularly relates to a seating unit having mechanically non-complex motion control elements, but which are efficient and effective.

Modern chairs often have backs and seats that move upon recline of a person seated in the chairs. More sophisticated chairs include motion control mechanisms to provide sliding and pivoting motions that move in a particular way relative to the seated user so as to provide an optimally comfortable and adjustable chair motion. However, these mechanisms tend to be sophisticated with rigid pivots and slide elements which can result in complex control mechanisms that have many pieces and that are difficult to assemble. In turn, the chair becomes expensive, and is subject to warranty issues. Further, the complex mechanisms take up space and can become structurally large in size, which is unacceptable for chairs requiring a thin profile or otherwise requiring a clean unobstructed area under their seat. Also, design of these mechanisms is a complex task, with substantial time required to understand and work out competing functional requirements and physical relationships.

Accordingly, a seating unit with motion control mechanism is desired having the aforementioned advantages and solving the aforementioned problems, including having a relatively small, compact mechanism that is flexible and adaptable for different circumstances, and yet that provides a comfortable motion. Also, a motion control mechanism is desired that is easier to incorporate into chair designs without substantial design time, prototyping, and testing.

SUMMARY OF THE PRESENT INVENTION

In one aspect of the present invention, a seating unit includes a base, a seat component, a back component, and a motion control having a center member adapted for attachment to at least one of said components. The motion control further has at least first and second flexible supports connected to the center member at spaced apart locations, the first and second flexible supports defining lengths that extend laterally in directions substantially parallel to each other and further having ends that are each operably connected to said base, said flexible supports being flexible in at least one direction but generally rigid in a generally perpendicular direction so that said at least one of said components is operably supported for movement relative to said base In another aspect of the present invention, a seating unit includes a seat component, a back component, a base positioned generally at opposite lateral side edges of said seat, and a motion control adapted for attachment to at least one of said components having at least first and second flexible supports connected to at least one of said components at spaced apart locations. The first and second flexible supports define lengths that extend laterally in directions substantially parallel to each other and further have ends that are each operably connected to said base. The flexible supports are flexible in at least one direction but are generally rigid in a generally perpendicular direction so that said at least one of said components is operably supported for movement relative to said base.

In another aspect of the present invention, a seating unit includes a base, a seat component, a back component, and a motion control having a center member and at least first and second flexible supports connected to the center member at spaced apart locations. The first and second flexible supports define lengths that extend laterally in directions substantially parallel to each other and further have ends positioned apart from said center member. The first and second flexible supports and said center member are molded of a polymeric material, one of the center member or the ends being operably connected to said base and the other being operably connected to at least one of said components. The flexible supports are flexible in at least one direction but are generally rigid in a generally perpendicular direction so that said at least one of said components is operably supported for movement relative to said base.

In yet another aspect of the present invention, a seating unit includes a pair of horizontally-spaced-apart stationary side supports adapted to be fixed to ground. A seat is configured and adapted to support a seated user. At least one flexible support extends between the stationary side supports and has ends that engage the side supports and has a center section that engages the seat. The flexible support both structurally and operably supports the seat for movement relative to the stationary side supports.

In still another aspect of the present invention, a seating unit includes a base, a seat configured and adapted to support a seated user, a polymeric frame component fixedly attached to and forming a structural part of at least one of the base and the seat, and at least one elongated flexible support, the at least one flexible support and the polymeric structural component being molded of plastic as a single integral part, with the at least one flexible support being configured to and supporting the seat for fore-aft movement relative to the base.

These and other features, objects, and advantages of the present invention will become apparent to a person of ordinary skill upon reading the following description and claims together with reference to the accompanying drawings.

BRIEF DESCRIPTION OF DRAWINGS

FIGS. 3–5 are front, top, and side views of FIG. 1;

FIG. 5A is a fragmentary side view of a modified version of the back pivot area, similar to FIG. 5, but with an integral back stop feature;

FIG. 6 is a side view similar to FIG. 5, but showing the chair in a reclined position;

FIG. 7 is a schematic side view of the motion control mechanism shown in FIG. 5;

DETAILED DESCRIPTION OF THE PREFERRED EMBODIMENT

Figure 1:
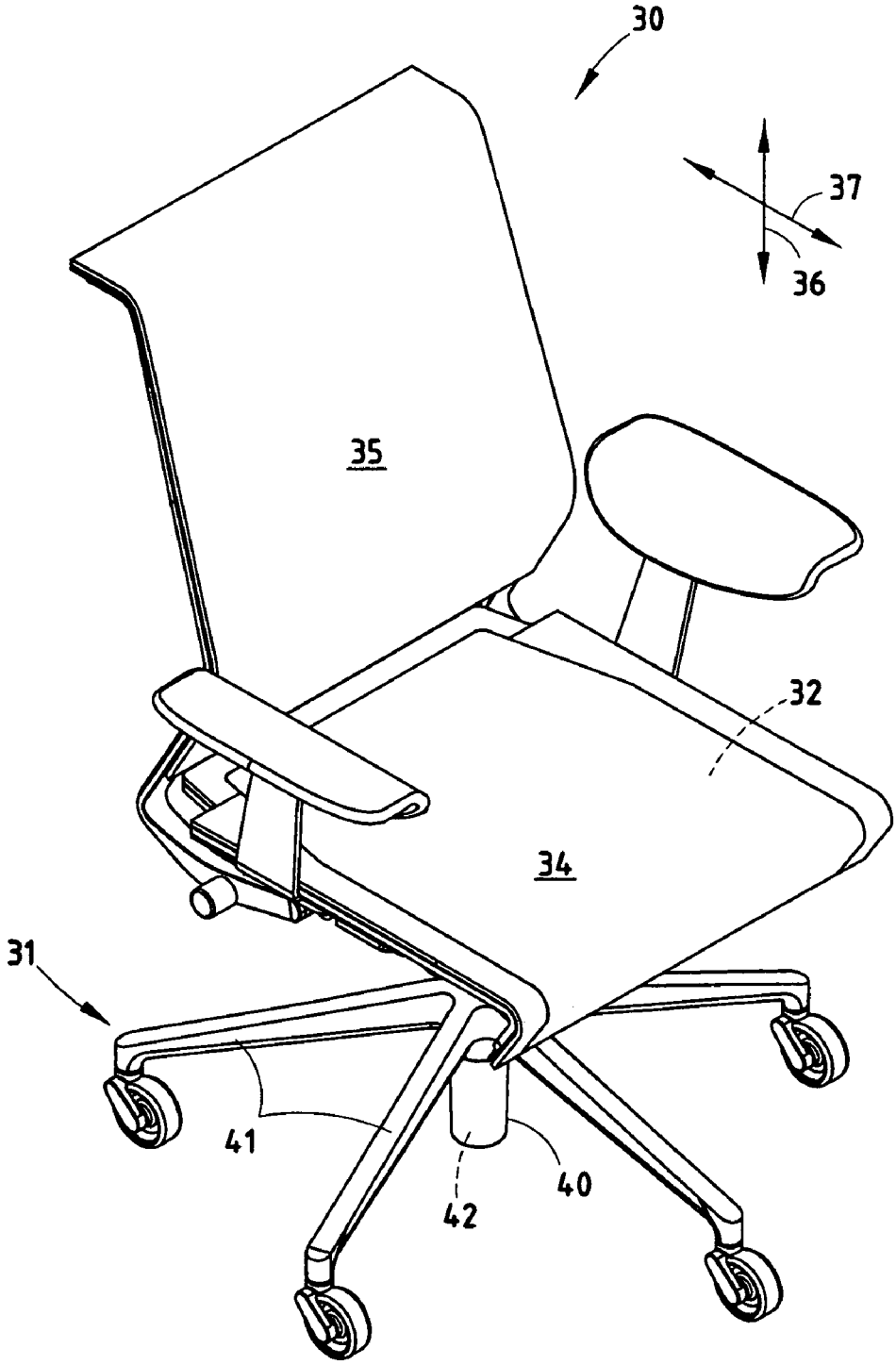
FIG. 1 is a front perspective view of a chair embodying the present invention.
Figure 2:
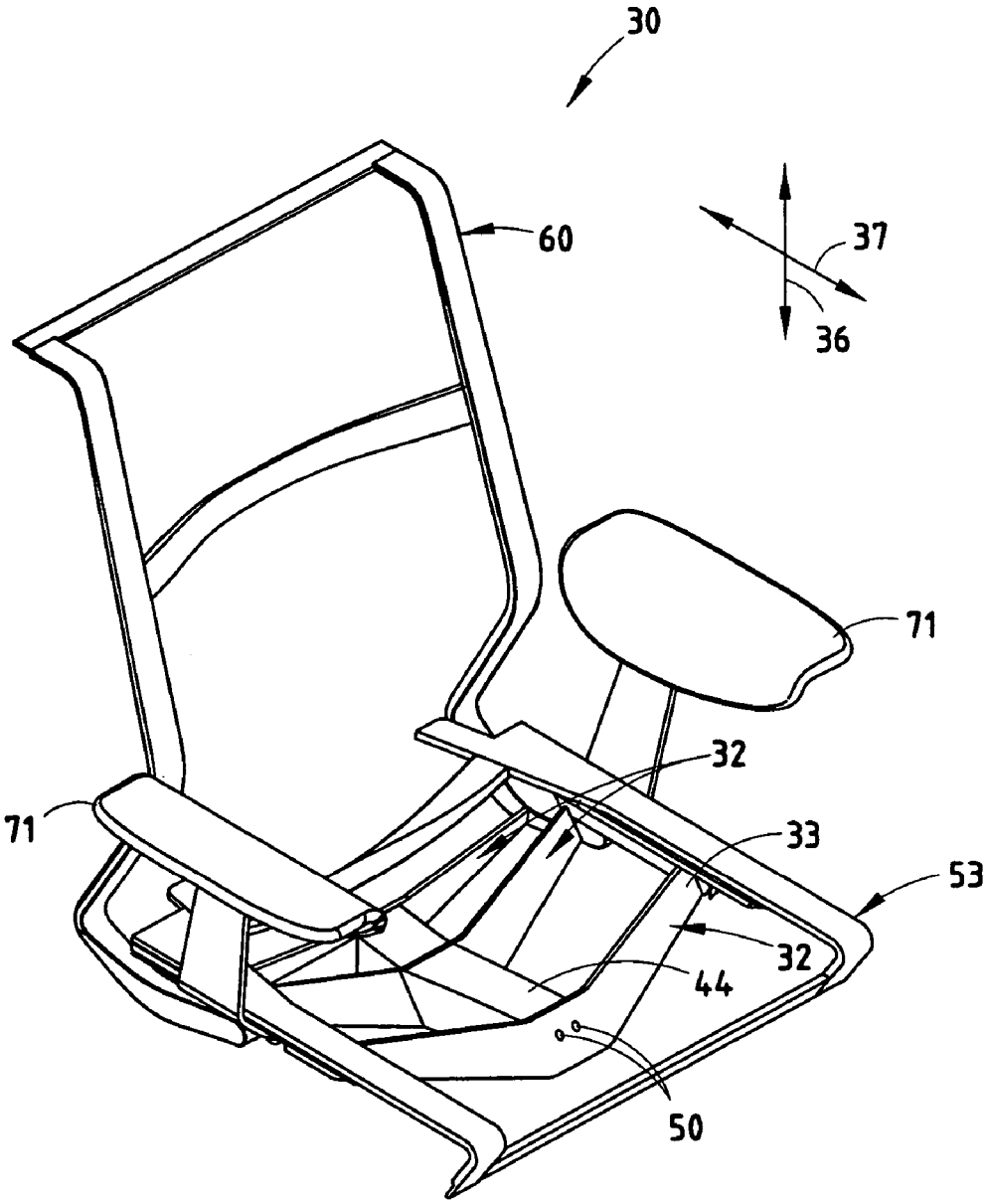
FIG. 2 is a front perspective view of FIG. 1, the seat, back, and base/legs being removed to better show the underlying components.
Figure 3:
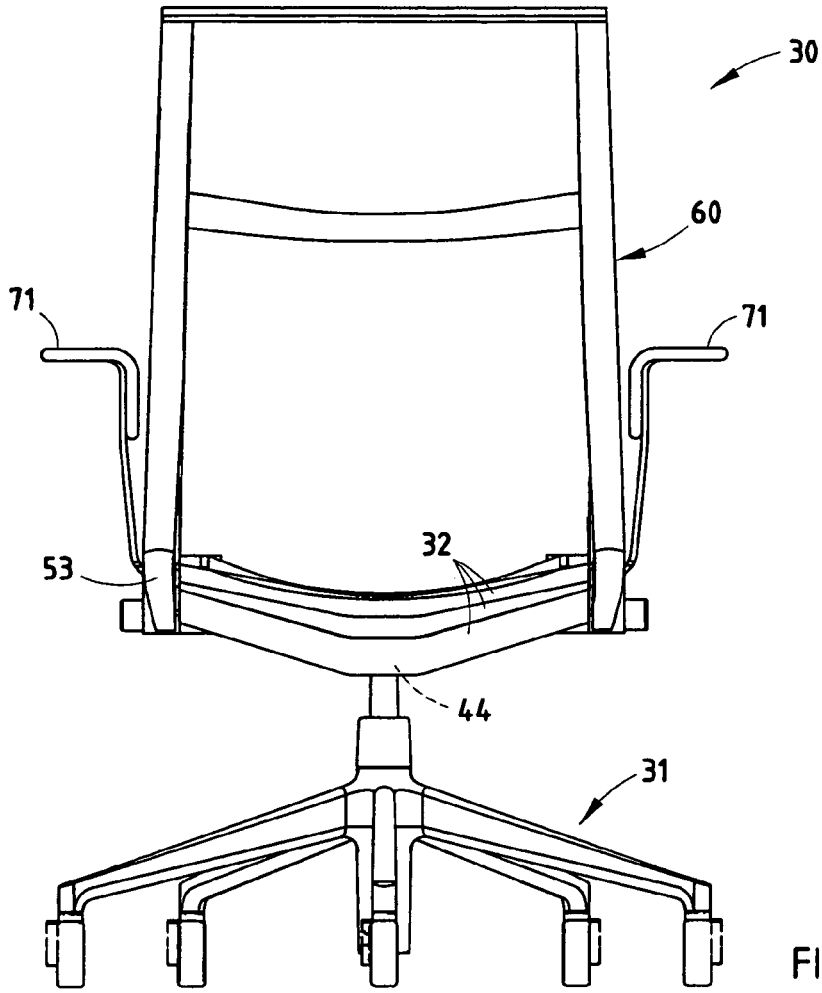
Figure 4:
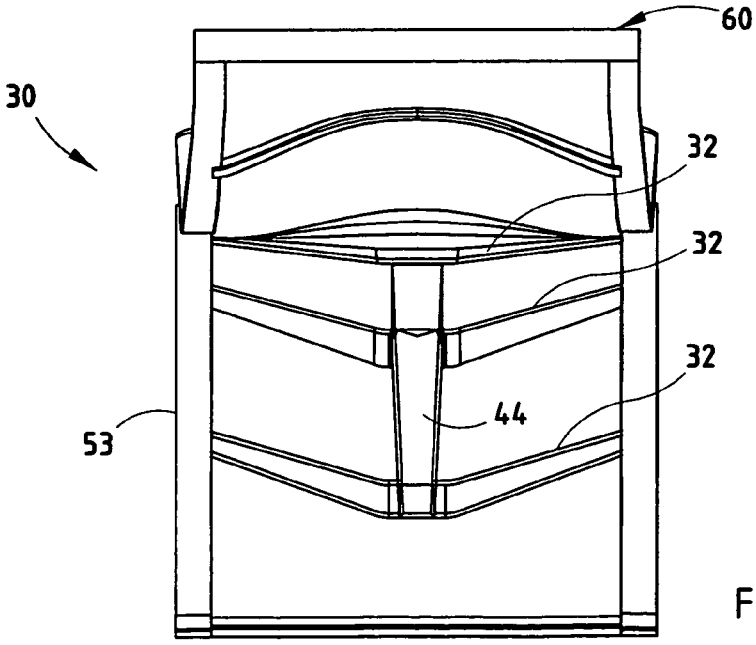

A seating unit or chair 30 (FIG. 1) includes a base 31, and includes a motion control mechanism (sometimes shortened and referred to as "motion control" herein) comprising a plurality of flexible supports 32 mounted to the base 31 for movably supporting a seat 34 and a back 35 on the base 31 for synchronous movement during recline. The flexible supports 32 are stiff in a generally vertical direction 37, but flexible in a generally fore-to-aft direction 36, and further, the flexible supports 32 have end sections 33 (FIG. 2) projecting generally outward from the central support 44 positioned in a relatively central area of the motion control. The end sections 33 move relative to the central support 44 during operation. The seat 34 and the back 35 are operably supported on and coupled to the end sections 33 of the flexible supports 32, so that when the flexible supports 32 flex in the generally fore-to-aft direction 36, they provide for synchronous movement of the seat 34 and/or the back 35, as described below. The illustrated flexible supports 32 comprise leaf-spring-like members forming a "flexible beam". The illustrated flexible supports have a vertical dimension for supporting considerable weight, yet have a relatively thin thickness dimension permitting their ends to flex and bend in a fore-aft direction and to absorb energy during their flexure. Further, the flexible supports 32 are slightly angled from a vertical orientation to provide a predetermined path of movement of the seat 34 and back 35, as discussed below. It is noted that the term "flexible" is used herein to mean that the supports 32 can move, such as by pivoting (see FIG. 12) or by resiliently bending (see FIG. 10).

Figure 8:
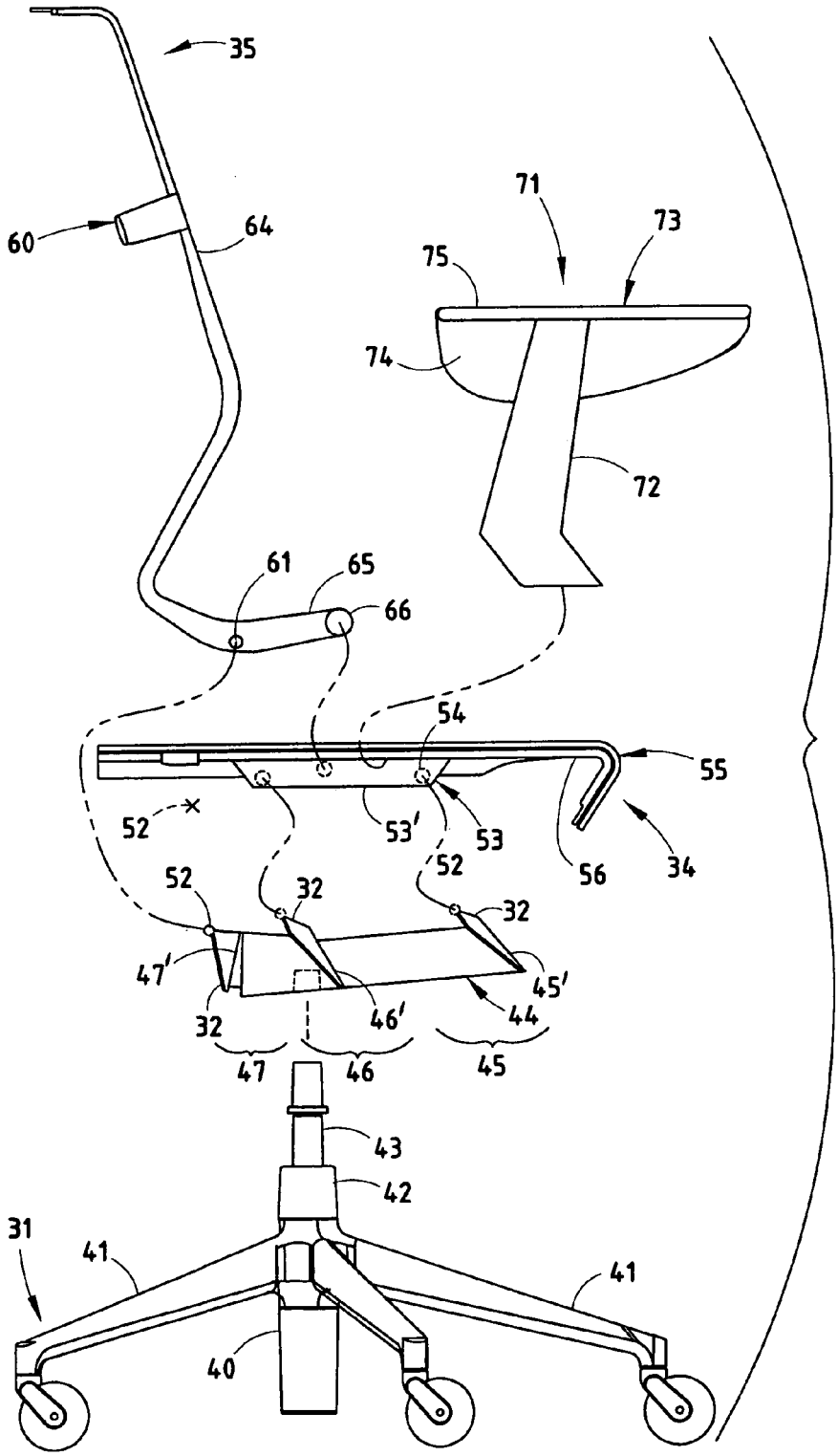
FIG. 8 is an exploded side view of FIG. 5

The base 31 (FIG. 1) includes a hub 40 and radially-extending castored legs 41. A center tube 42 extends vertically from the hub 40, and a vertically-extendable pneumatic spring 43 (FIG. 8) is positioned in the tube 42 for providing a pneumatically-assisted chair height adjustment. The illustrated base 31 includes a base plate or central support 44 with multiple mounting locations or mounting sections 45–47 thereon. Other types of bases, such as beams, posts, and attachment plates (whether movable or immovable) are contemplated.

The illustrated support 44 includes three mounting areas 45–47. A bottom of the central support 44, near middle mounting area 46 (FIG. 8) includes a tapered bottom recess for mateably engaging a top of the pneumatic spring 43. The mounting areas 45–47 each include an angled surface or slot 45'–47' for receiving the supports 32. The illustrated front two angled surfaces 45' and 46' (FIG. 5) face forwardly and are angled rearwardly with respect to vertical about 40° to 50°. More preferably, the front angled surface 45' extends at about 46° and the middle angled surface 46' extends at about 42°. The angled surfaces 45' and 46' are nearly parallel, but the middle angled surface 46' has a slightly smaller angle, such that during recline, the end sections 33 of the middle flexible support 32 move upwardly at a slower rate than the end sections 33 of the front flexible support 32. This causes the seat 34 to move translationally and angularly along a predetermined preferred path 48 upon recline, as discussed below. The angled surface 47' faces rearwardly and is tipped forwardly such that it is at a reverse angle to the front angled surfaces 45' and 46', with the surface 47' being at an angle of about 15° to 25° from vertical (with a 20° angle being preferred). It is noted that the angle of the supports 32 can be changed by using replaceable wedge-shaped spacers, such spacer 145 (FIGS. 5–7). However, it is desirable to keep the pivot locations (i.e. bearings 52) at the same locations so that the seat and back paths do not unacceptably change away from the intended design upon recline, and so that the supports 32 do not move and flex in a dramatically different way.

The illustrated flexible supports 32 (FIG. 9) (also called "flexible beams") are planar leaf-spring-like members. The term "flexible" is used herein to define any fore-aft movement, including bending or pivoting, while the term "resilient" is used herein to mean bending along with energy absorption during flexure. Each support 32 includes an enlarged center section 49 attached to the angled surfaces 45'–47' by fasteners 50, and further includes resiliently flexible arms 51 that taper in height toward the end sections 33 and that are supported on bearings 52. The bearings 52 (FIG. 9) operably receive the outer ends of the arms 51, such that the outer ends can both slip linearly and also rotate as the arms 51 flex and move. It is contemplated that various connecting arrangements can be made for connecting the ends of the arms 51 to the frames of the seat 34 or back 35. For example, a bearing arrangement 100 (FIGS. 10A) includes a polymeric stationary support bearing 101 positioned in a bore 102 in the illustrated seat frame section 103. The bearing 101 includes a vertically elongated slit 104 with tapered front and rear ends 105 and 106 shaped to receive the end 107 of the arm 51. The ends 105 and 106 form an "hour-glass" shaped slot arrangement that allows the end 107 of the arm 51 to rock back and forth and telescopingly slip as the support 32 is flexed. This helps distribute stress on the end 106 as the arm 51 of the flexible supports 32 are flexed, and eliminates "point" stress that may be damaging to or wearing on the arm 51. Also, the mating/abutting shape of the front and rear ends 105 and 106 engage the end 107 of the arms 51 to act as a stop that limits the reclining motion.

It is contemplated that other steps to limit the reclining motion can be added. The modified arrangement shown in FIG. 5A includes an arcuate slot 53A' in the seat frame 53A that extends partially around the back pivot 66A. A pin 55D' in an end of leg 65D slides along the slot 53A' and engages ends of the slot 53A' to stop the back 35 in the upright and reclined positions. There are other ways that a back stop mechanism can be provided. For example, a fixed radially extending protrusion can be connected to the pivot pin at back pivot 66, with the protrusion engaging a bottom of the seat frame upon reaching a maximum recline position. This back stop mechanism could be modified to become adjustable, by using a rotatable stepped wheel on the pin at back pivot 66 instead of a fixed protrusion on the pin, with steps on the wheel selectively engaging a lip on the seat frame to set different maximum recline positions.

A modified bearing arrangement 110 (FIGS. 10C–10D) includes a modified end 111 to the flexible support 32. The modified end 111 includes a flattened section 112 with a longitudinal slot 113 therein (FIG. 10D). A threaded fastener 114 (FIG. 10C) is extended through a bushing 115 up through the slot 113 and a washer 116 threadably into a hole 117 in the side section 118 of a seat frame. The threaded fastener 114 includes a shaft 119 that slides back and forth in the slot 113 as the flexible support is flexed during recline. The shaft 119 engages the ends of the slot 113 to limit the seat (or back) in the upright and recline positions.

It is also contemplated that the bearings 52 can be cylindrically or spherically shaped and attached to ends of the supports 32, and operably positioned in a bore in the seat frame for simultaneous rotation and telescoping movement.

The illustrated arms 51 (FIGS. 9–10) have a larger vertical dimension near the center section 49 and a smaller vertical dimension near their ends, but it is contemplated that the arms can have a variety of shapes. The illustrated flexible supports 32 have a constant thickness, but it is also contemplated that the thickness may be varied along their length to provide a particular force versus deflection curve upon recline. The illustrated flexible supports 32 are made of spring-steel, but they could be made of reinforced (or nonreinforced) polymeric materials, composite materials, and other materials as well. Accordingly, flexible supports 32 can be manufactured individually out of flat sheet stock (or molded or otherwise individually formed into more complex shapes) or can be molded into a single structure with central support 44. It should also be noted that flexible supports 32 are stiff, yet resilient and store energy upon flexure in the fore-aft direction in the preferred embodiment. Where pretension is applied to the support 32 to assist in holding the chair in a raised position, the support 32 preferably is made of a material that will not creep, such as spring-steel.

Because of the angle of surfaces 45'–47' and because of the interaction of back frame 60 and seat frame 53 with supports 32, the seat 34 is actually lifted during recline. (Compare FIG. 5 which is the upright position, with FIG. 6, which shows the recline position.) This seat-lifting action helps provide the additional energy necessary when the heavier person reclines. In other words, the energy stored during recline (i.e. due to the seat being lifted) provides some of the energy to assist the seated person when moving from the reclined position toward the upright position. Because the back frame 60 experiences the greatest change in load, it is contemplated that the rearmost flexible support 32 resists flexure the strongest (or, said another way, stores the most energy on recline) while the forwardmost flexible support 32 need not necessarily be as strongly resistant to flexure in the fore-to-aft direction.

The illustrated seat 34 (FIG. 8) includes a seat carrier or frame 53 with side sections having front and rear cylindrical recesses 54 for receiving the bearings 52 of the front and middle flexible supports 32. The illustrated frame 53 is U-shaped, and includes side sections 53' defining a perimeter of the seat area. A seat subassembly 55 is attached atop the frame 53, and includes a generally planar, cushioned semi-resilient support 56 extended between the sides of its subframe. It is contemplated that this support can be replaced with a fabric or replaced with a more contoured cushion (whether thick or thin). Thicker or thinner cushions can also be placed on the frame 53. It is also contemplated that other traditional and non-traditional seats can be used on the present invention.

The back 35 (FIG. 8) includes a back carrier or frame 60 with side sections having front and rear cylindrical recesses 61 for receiving the bearings 52 of the rear flexible support 32. The illustrated frame 60 has an inverted U-shape that defines a perimeter of the back. A generally resilient cushioned support panel 64 is extended between the sides of the frame 60. It is contemplated that the cushioned panel support 64 can be replaced with a fabric or replaced with a cushioned or contoured panel. A cushion can also be placed on the frame 60. It is also contemplated that other traditional and non-traditional backs can be used on the present invention.

The back frame 60 includes lower legs 65 pivoted to a rear of the seat frame 53 at back pivot 66. Forward and rearward back stops (not shown) are used at back pivot 66 to control the amount of back recline, which preferably is approximately 22° of back recline motion in an office chair product. Other types of seating units may have different preferred ranges of back recline. It is contemplated that the flexible supports 32 can be given a pretension during assembly of the flexible supports 32 to the chair, so that the back 35 provides an initial level of support force to a seated user. This initial level must be overcome before the back 35 will permit recline. This pretension can result solely from the strength of the flexible supports 32, and/or can be from separate springs used to supplement the strength of flexible supports 32 to provide an initial level of support before the back will recline. For example, torsion springs can be operably attached at the pivot 66 to provide a bias on the back 35 to an upright position. Also, a coil spring could be operably connected between the seat and center support 44. Also, a variety of different arrangements are possible for controlling the location of the upright and recline positions, as will be apparent to artisans skilled in this art. In the illustrated arrangement, the rearmost support 32 is made of steel, and carries a bulk of any pretension, while the front two supports 32 carry less pretension and hence can be made of polymeric materials (which would creep over time if pretensioned).

Armrest assemblies 71 (FIG. 8) include an upright support 72 attached to the side sections of the seat frame 53, and further include an armrest body 73 comprising an L-shaped structural support 74 and a cushion 75. It is contemplated that a variety of different armrests can be used on the present invention.

Figure 9:
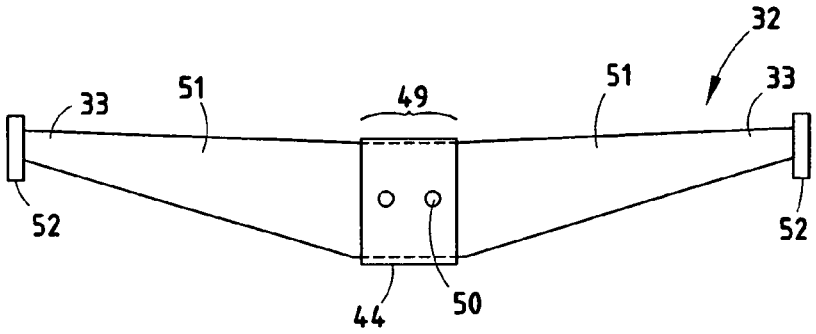
FIG. 9 is a front view of the flexible supports of the underseat motion control mechanism shown in FIG. 5.
Figure 10:
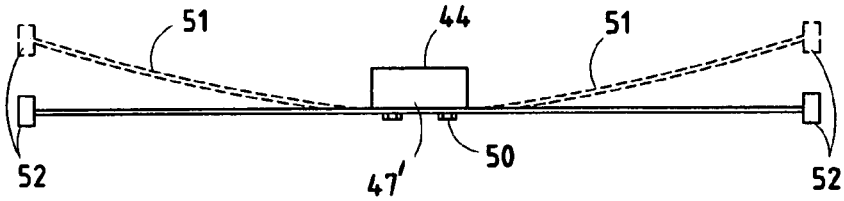
FIG. 10 is a top view of FIG. 9, the solid lines showing an at-rest position and the dashed lines showing flexure of the flexible support of FIG. 9.
Figure 11:
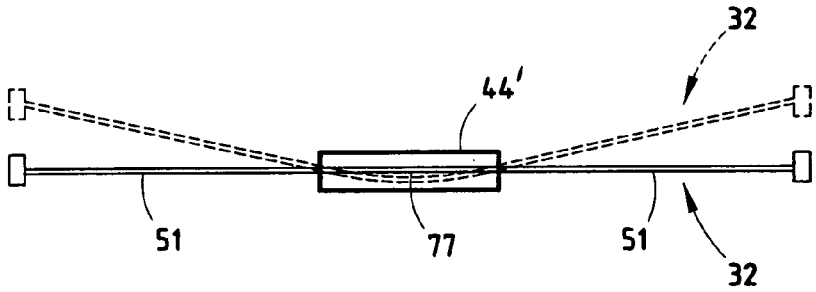
FIG. 11 is a top view of an alternative motion control mechanism, where the support block is a box-shaped shell and the illustrated flexible support has a resilient bendable center section.
Figure 10A:
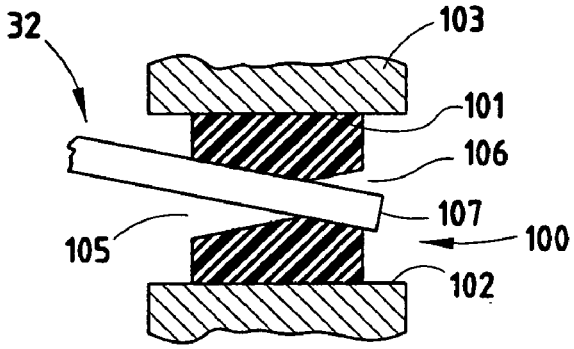
FIGS. 10A–10B are enlarged cross-sectional and end views of the outer end of the flexible support of FIG. 5, showing coupling of the outer end to the stationary base frame.
Figure 10B:
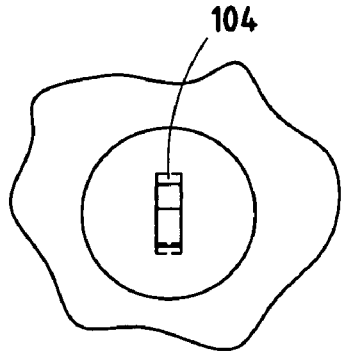
Figure 10C:
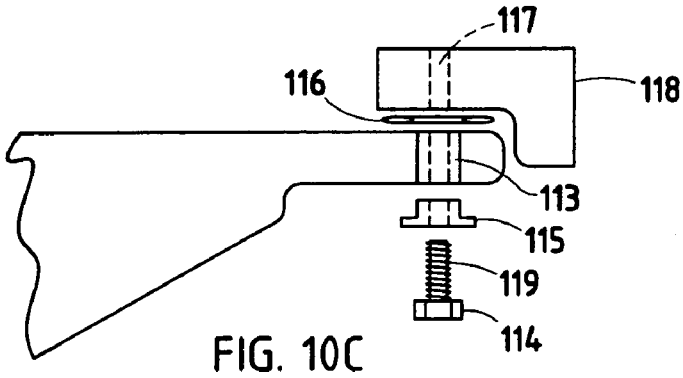
FIGS. 10C–10D are enlarged cross-sectional and end views similar to FIGS. 10A–10B, but showing an alternative embodiment.
Figure 10D:
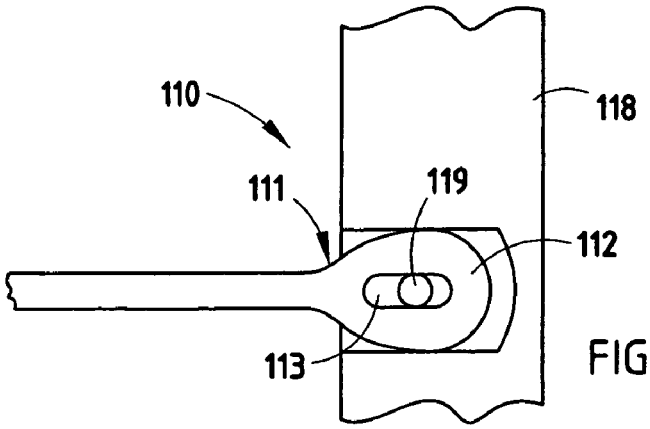

In FIGS. 9–10, a center of the flexible support 32 is fixed to the mating angled surface on one of the blocks of the central support 44 by screws 50. In FIG. 11, the central support is modified to be a box-shaped structure 44' or concave structure that permits a center section 77 of the flexible support 32 to resiliently bend and flex when the arms 51 flex. As can be seen, this causes an effective length of the arms 51 to be "longer", due to flexure of the center area 77 of the flexible support 32. It is noted that the arms 51 themselves may be strong enough to stay straight (see FIG. 11) or may themselves resiliently bend (see FIG. 10). Where resilient leaf-spring-like supports 32 are used, the vertical dimension is large enough relative to its width dimension (i.e. its thickness), so that the vertical beam stiffness is at least about 50 times its lateral bending stiffness. The reason for this 50:1 ratio is so that the supports 32 can carry considerable weight, while allowing fore-aft movement with less force. As this ratio declines, there is less control of the seat and back movement, and a stiffer fore-aft movement, which results in a less controlled feel to a seated user.

Figure 12:
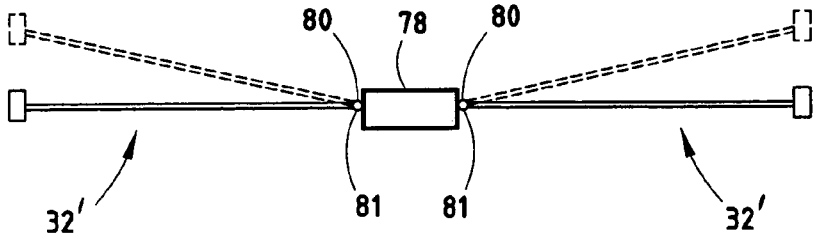
FIG. 12 is a top view of an alternative motion control mechanism, where the flexible support is rigid and pivoted to the support block at an inner end, the flexible support being spring-biased toward a home position.

FIG. 12 illustrates a motion control mechanism utilizing modified flexible supports 32'.

The arm sections 51 are relatively stiff and not resilient, but the arms 51 are pivotally mounted to sides of the central support box 78 at pivot locations 80 such that they are flexible. Further, torsion springs 81 could be attached at pivot locations 80 to bias the arms 51 toward their upright positions. (The solid lines illustrate the upright positions, and the dashed lines represent the fully reclined positions.)

Figure 13:
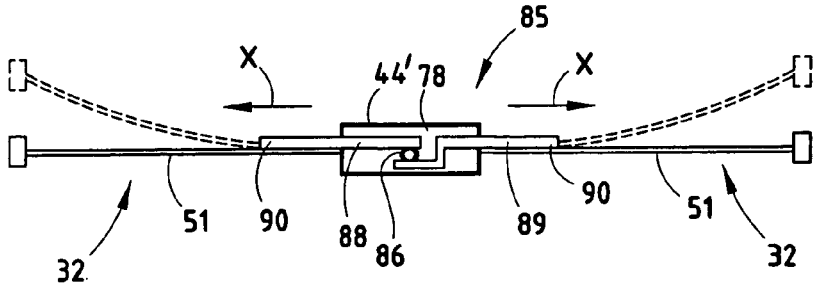
FIG. 13 is a top view of a motion control mechanism similar to FIG. 10, and including an adjustable device for changing an effective length of the flexible section of the flexible supports.

FIG. 13 illustrates an adjustable back stiffness mechanism 85 attached to the motion control of FIG. 11 instead of to the pivots 66. In the back stiffness mechanism 85, a rotatable gear 86 is attached within the box 78 and is connected to a lever or handle in a convenient location for manipulation by a seated user. A pair of slides 88 and 89 are positioned in the box 78, with their outer end sections 90 extending outward in sliding engagement with the arms 51. The slides 88 and 89 include inner end sections with racks that operably engage the gear 86. As the gear 86 is rotated, the outer end sections 90 are driven outward in direction X. This results in a shorter effective length of the arms 51. This, in turn, dramatically increases the stiffness during recline, since the shortened length of arms 51 must be bent to a much greater extent to reach a fully reclined position. This increased stiffness would support a heavier user during recline.

In the description of chairs and motion control components below, components that are similar to or identical to the components of chair 30 are described using the same identification numbers, but with the addition of the letters "A", "6", "C", "D", and "E", respectively. This is done to reduce redundant discussion.

Figure 14A:
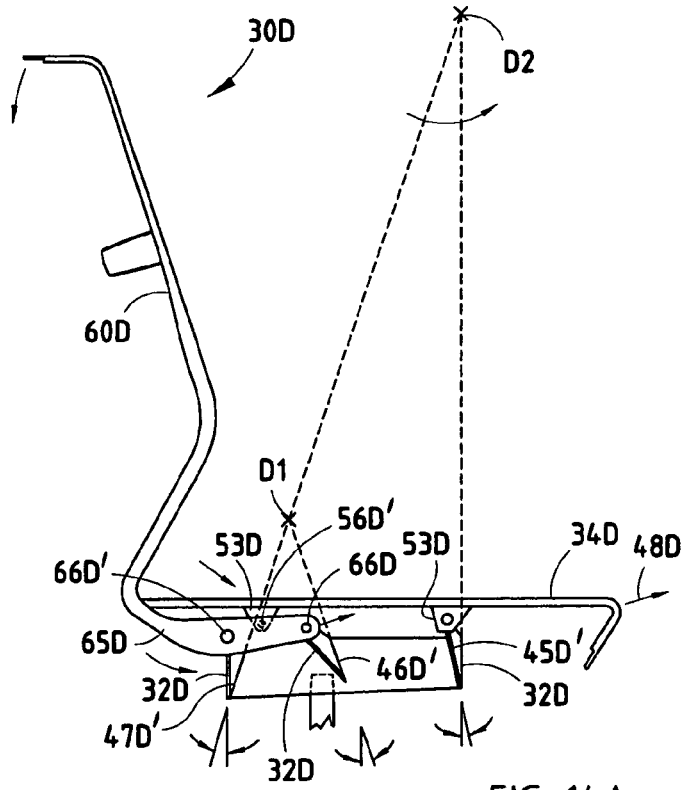
FIG. 14A is a side view of another modified chair similar to FIG. 5, but having a synchronized seat and back motion where the seat moves forward upon recline of the back.
Figure 14:
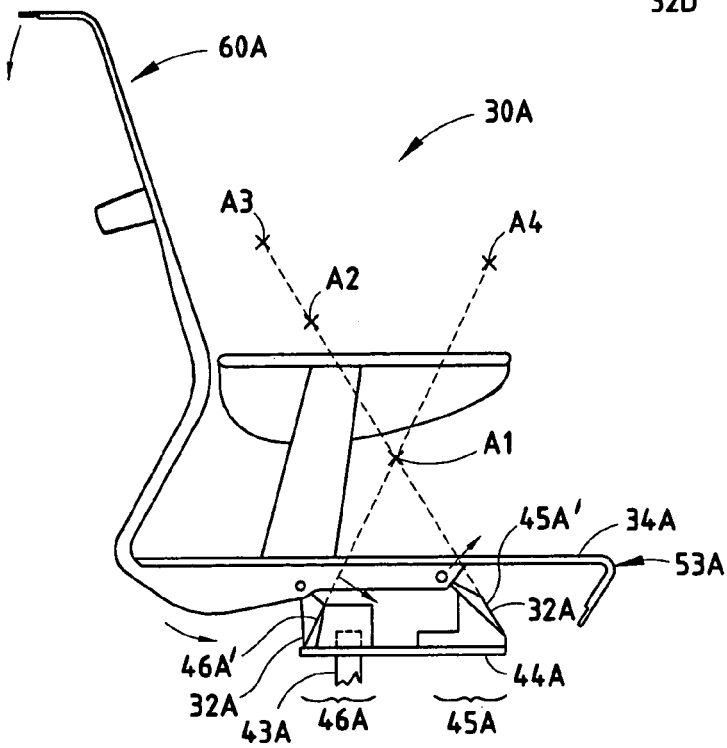
FIG. 14 is a side view of a modified chair embodying the present invention, the modified chair including a pair of flexible supports and a one-piece bucket forming a back and seat that, upon recline, rotate about an axis aligned near the center of gravity of the seated user.

A modified chair 30A (FIG. 14) is shown that is not unlike the chair 30. However, the chair 30A includes a one-piece unitary seat and back 34A (i.e. a "bucket" type chair), and further includes only two flexible supports 32A. Specifically, the base tube 43A supports a base plate 44A having two mounting blocks 45A and 46A. The middle mount block 46A includes a tapered bottom recess for mateably engaging a top of its pneumatic spring 43A. The front angled surface 45A' is angled rearwardly about 35° to 55°, or more preferably about 45°. The rearward angled surface 46A' is angled forwardly a small amount, such as about 5° to 15°, or more preferably about 10°. During recline, this causes a rear of the seat section 34A to drop and the front of the seat section 34A to rise while seat section 34A moves forward about a virtual pivot located about at a seated user's center of gravity. Also, a top edge of the back section 35A pivots downwardly as well as rearwardly during recline. (See arrows in FIG. 14.) The net result is that the seat and back pivot about a pivot axis A1 that is located above the seat, such as at a location about equal to a seated user's center of gravity. Notably, the axis of rotation is easily and predictably changeable. For example, axis A1 is located at the intersection of lines extending from the surfaces 45A' and 46A'. If rear surface 46A' is changed to be oriented vertically, the axis of rotation upon recline becomes A2. If surface 46A' is changed to be oriented at about 5° rearwardly, the axis of rotation upon recline becomes axis A3. Similarly, if the angle of rear surface 46A' is not changed, but instead, the angular orientation of surface 45A' is changed to vertical, the axis of rotation upon recline becomes A4. It is specifically contemplated that the axis of rotation of either the back or seat can be controlled by this method. (Compare FIG. 14 to FIGS. 5 and 6.) The chair 30D (FIG. 14A) illustrates this concept. The chair 30D has a seat forward motion upon back recline that is similar to the motion of the synchrotilt chair disclosed in U.S. Pat. No. 5,975,634 (issued Nov. 2, 1999, entitled "Chair Including Novel Back Construction", to Knoblock et al.), where a front of the seat moves forward and up during recline and where a rear of the seat moves forward and down during recline. To obtain this result, the front flexible support 32 is mounted at an angle of about 4°, while the middle flexible support 32 is mounted at an angle of about +20°, and the rear flexible support 32 is mounted at an angle of about −20°. Also, the back frame leg 65D is pivoted to an end of the middle support 32D at pivot 66D, while the seat frame 53D is pivoted to the back frame leg 65D at pivot 53D'. When flexed, the pivot 66D moves forward and up, while the rear pivot 66D' moves forward and down. As a result, the back 60D rotates about axis D1 while the seat 34D rotates forward about axis D2 upon recline.

It is contemplated that a chair can also be constructed to include only a single flexible support at a rear of the seat. In such case, the front of the seat is supported by a sliding bearing arrangement, such as a linear bearing on the seat that slides on a track on the base plate. It is noted that the track can be made linear, curvilinear, or arcuate, as desired. Also, biasing springs can be operably attached to the bearing and/or the seat to assist in biasing the seat (and back) to an upright position.

Figure 15:
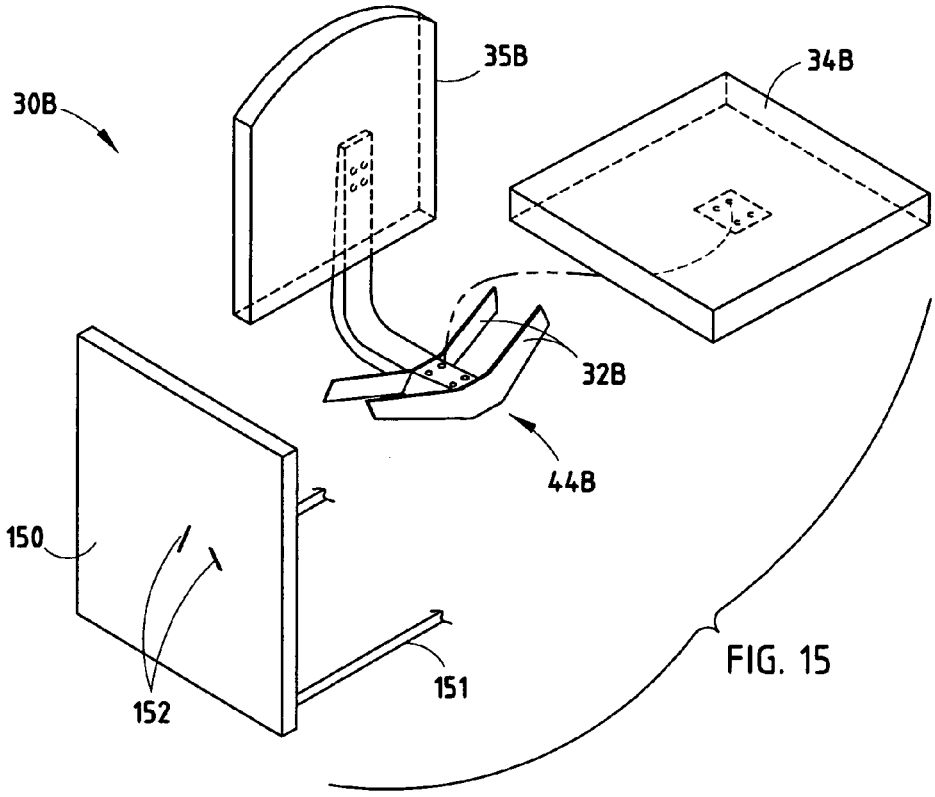
FIG. 15 is a perspective view of another modified chair embodying the present invention, the chair including stationary upright side panels, two flexible supports with ends supported by the side panels, and a seat/back bucket mounted to a center of the flexible supports for reclining movement.

Notably, the flexible supports 32 can be "reversed", with their ends being supported by a stationary member, and their central support 44 being movable upon recline. Chair 30B (FIG. 15) illustrates one such arrangement. It is contemplated that this chair 30B would potentially be useful in a stadium or auditorium or mass transit seating arrangement. Chair 30B includes a pair of spaced-apart stationary side panels 150 secured stably together, such as by connecting rods 151. The flexible supports 32B are positioned with the outer ends of their arms 51B slidably/telescopingly engaging apertures 152 in the panels 150. A central support 44B is attached to a center section of the flexible supports 32B. A seat 34B and back 35B are fixedly attached to the central support 44B. Notably, the back 35B can include a back frame or support panel having some flexibility and compliance for increased comfort. Also, the seat 34B can have a similar flexibility. Side edges of the seat 34B move along a path between and proximate the side panels 150. This helps keep the seat "square" and stable during recline.

Figure 16:
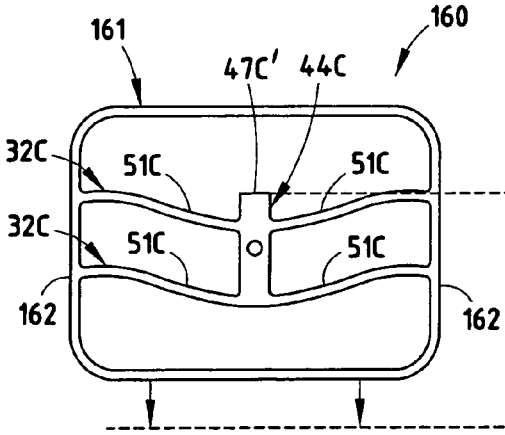
FIGS. 16–17 are top views of a modified motion control mechanism similar to FIG. 2, but where the flexible supports are molded along with the center support block and the seat frame as a one-piece integral molding, FIG. 16 showing the molding in an unstressed condition and FIG. 17 showing the molding in a stressed condition with the seat frame section moved rearward relative to the center support, such as will occur during recline.
Figure 17:
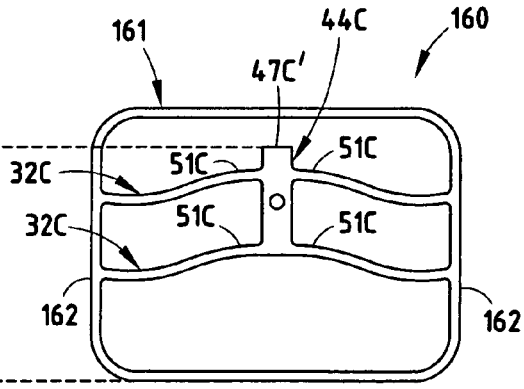

In another variation, a unitary control construction 160 (FIGS. 16–17) is provided where the flexible supports 32C are integrally molded to both the seat frame 161 and the central support 44C. As illustrated, the flexible supports 32C have arms 51C with an S-shaped configuration when viewed from above. As the central support 44C is moved rearwardly upon recline, the arms 51C flex and resiliently bend, temporarily pressing the side sections 162 of the seat frame 161 outwardly slightly. Thus, both the flexing of the flexible supports 32C and also the flexing of the side sections 162 provide stored energy for assisting a seated user to move from a recline position to the upright position. Further, since the illustrated assembly is a one-piece molding, manufacturing costs are lowered and assembly costs are virtually eliminated in regard to the illustrated components. Notably, the central support 44C includes an angled rear mounting surface 47C' where a steel leaf-spring-like member can be mounted, so as to provide a steel support that can be pretensioned without fear of creeping.

Figure 18:
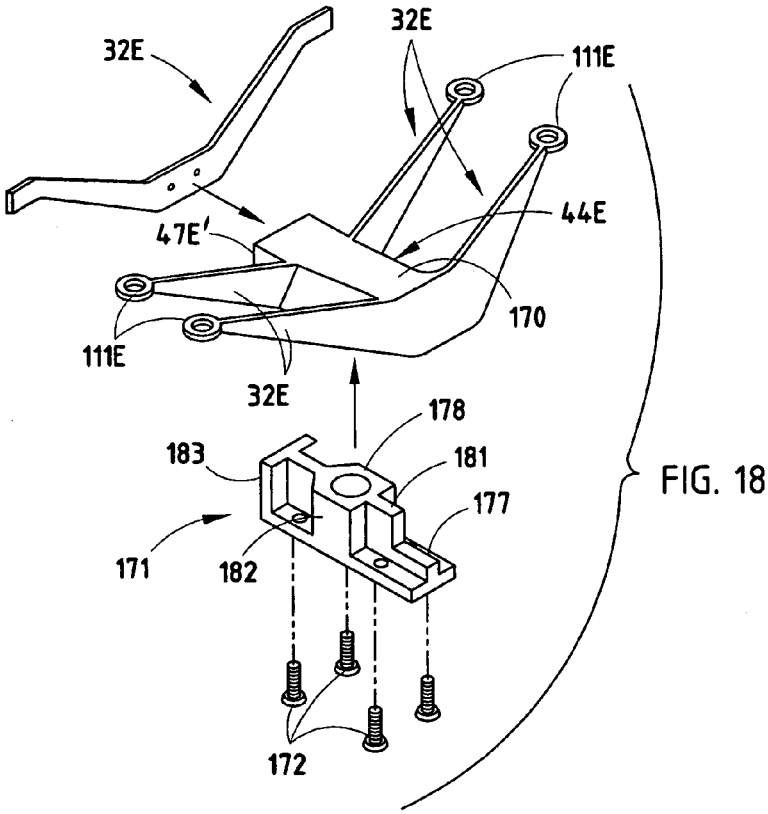
FIG. 18 is an exploded perspective view of a modified motion control mechanism, where the flexible supports are integrally molded with a hollow central support, and where a cast metal member mounts to bottom of the central support for engaging a base pneumatic post.
Figure 19:
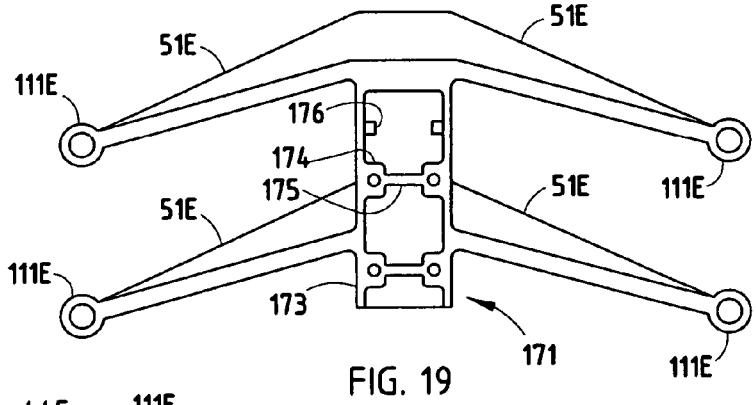
FIGS. 19 and 20 are top and side views of the molded member shown in FIG. 18.
Figure 20:
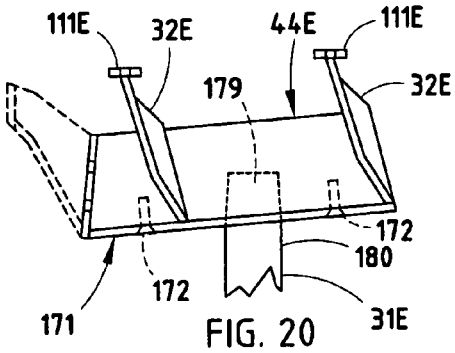

FIGS. 18–20 illustrate a motion control mechanism where the front two flexible supports 32E are integrally molded of plastic as arms extending from sides of a hollow box-shaped housing 170, and where the central support 44E comprises a cast metal member 171 attached with screws 172 into a bottom recess of the hollow housing 170. The rear support 32E is made of spring-steel and is attached by screws to a rear angled mounting surface 47E' formed by an end of the housing 170. The housing 170 (FIG. 19) includes sidewalls 173, bosses 174 on the sidewalls for receiving the screws 172, transverse ribs 175 for reinforcement, and interlock tabs 176. The cast metal member 171 includes a plate 177 shaped to engage the sidewalls 173 and cover the bottom of the housing 170. An inverted cup-shaped structure 178 forms a tapered socket for receiving a top tapered section 179 of the pneumatic height-adjustable post 180 on base 31E. Ribs 181 and 182 and end plate 183 stabilize the structure 178 on the base plate 177, and further interfit between the bosses 174 and interlock tabs 176 to form a secure nested assembly of the cast metal member 171 to the housing 170. Notably, the arms 51E are angled and the end sections are raised above the housing 170, such that even though the illustrated arms 51E are generally planar, they have the appearance shown in FIGS. 19–20 when viewed from above and from a side view.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A seating unit, comprising:

a base;

a seat component;

a back component; and a motion control having a center member extending in a front to back direction of the seating unit and adapted for attachment to at least one of said components, said motion control further having at least first and second flexible supports connected to the center member at spaced apart locations, the first and second flexible supports defining lengths that extend laterally in directions substantially parallel to each other and substantially perpendicular to the direction of the center member, and further having ends that are each operably connected to said base, said flexible supports being flexible in at least one direction but generally rigid in a generally perpendicular direction so that said at least one of said components is operably supported for movement relative to said base.

2. The seating unit defined in claim 1, wherein said ends are connected to said base at opposed lateral side edges of said base.

3. The seating unit defined in claim 1, wherein said base includes side supports, and wherein the flexible supports are slidably supported by the side supports.

4. The seating unit defined in claim 3, wherein said side supports comprise vertically-extending parallel side panels.

5. The seating unit defined in claim 1, wherein at least one of said first and second flexible supports is integrally molded as part of at least one of said base, said seat component and said back component.

6. The seating unit defined in claim 1, wherein said first flexible support is integrally molded with said center member and is formed of a same material.

7. The seating unit defined in claim 6, wherein said first flexible support comprises polymeric material.

8. The seating unit defined in claim 1, wherein said first flexible support includes a vertical cross section that defines a long width dimension and a narrow thickness dimension, the long width dimension providing stiffness in a first direction parallel the long width dimension to support at least part of a weight of the seating unit and the narrow thickness dimension providing flexibility in a second direction parallel the narrow thickness dimension, whereby a weight of the seated user is structurally supported and also operably supported for movement relative to the base.

9. The seating unit defined in claim 1, wherein said first flexible support has a cross section that is elongated and that changes in width along a length of the first flexible support.

10. The seating unit defined in claim 1, wherein said first flexible support has a cross section that defines a direction of elongation, the direction of elongation extending at an angle relative to a vertical direction.

11. The seating unit defined in claim 1, wherein said base includes side supports, and wherein said central component is positioned at least partially between the side supports.

12. A seating unit, comprising:

a seat component;

a back component;

a base positioned generally at opposite lateral side edges of said seat; and a motion control adapted for attachment to at least one of said components having at least first and second flexible supports connected to at least one of said components at spaced apart locations, the first and second flexible supports defining lengths that all extend laterally in directions substantially parallel to each other and further have ends that are each operably connected to said base, said flexible supports being flexible in at least one direction but generally rigid in a generally perpendicular direction so that said at least one of said components is operably supported for movement relative to said base, and wherein said first flexible support has a cross section that is elongated and that changes in width along a length of the first flexible support.

13. The seating unit defined in claim 12, wherein said ends are connected to said base at opposed lateral side edges of said base.

14. The seating unit defined in claim 12, wherein said base includes side supports, and wherein the flexible supports are slidably supported by the side supports.

15. The seating unit defined in claim 14, wherein said side supports comprise vertically-extending parallel side panels.

16. The seating unit defined in claim 12, wherein at least one of said first and second flexible supports is integrally molded as part of at least one of said base, said seat component and said back component.

17. The seating unit defined in claim 12, wherein said first flexible support is integrally molded with said one component and is formed of a same material.

18. The seating unit defined in claim 17, wherein said first flexible support comprises polymeric material.

19. The seating unit defined in claim 12, wherein said first flexible support includes a vertical cross section that defines a long width dimension and a narrow thickness dimension, the long width dimension providing stiffness in a first direction parallel the long width dimension to support at least part of a weight of the seating unit and the narrow thickness dimension providing flexibility in a second direction parallel the narrow thickness dimension, whereby a weight of the seated user is structurally supported and also operably supported for movement relative to the base.

20. The seating unit defined in claim 12, wherein said first flexible support has a cross section that defines a direction of elongation, the direction of elongation extending at an angle relative to a vertical direction.

21. The seating unit defined in claim 12, wherein said base includes side supports, and wherein said one component is positioned at least partially between the side supports.

22. A seating unit, comprising:

a base;

a seat component;

a back component; and a motion control having a center member extending in a front to back direction of the seating unit and and at least first and second flexible supports connected to the center member at spaced apart locations, the first and second flexible supports defining lengths that extend laterally in directions substantially parallel to each other and substantially perpendicular to the direction of the center member, and further have ends positioned apart from said center member, the first and second flexible supports and said center member being molded of a polymeric material, one of the center member or the ends being operably connected to said base and the other being operably connected to at least one of said components, said flexible supports being flexible in at least one direction but generally rigid in a generally perpendicular direction so that said at least one of said components is operably supported for movement relative to said base.

23. The seating unit defined in claim 22, wherein the first flexible support and said center member are molded of a polymeric material as a single one-piece unit.

24. The seating unit defined in claim 22, wherein the second flexible support also is molded as part of the single one-piece unit.

25. The seating unit defined in claim 22, wherein said ends are connected to said base at opposed lateral side edges of said base.

26. The seating unit defined in claim 22, wherein said base includes side supports, and wherein the flexible supports are slidably supported by the side supports.

27. The seating unit defined in claim 22, wherein said first and second flexible supports are integrally molded as part of at least one of said base, said seat component and said back component.

28. The seating unit defined in claim 22, wherein said first flexible support comprises polymeric material.

29. The seating unit defined in claim 22, wherein said first flexible support includes a vertical cross section that defines a long width dimension and a narrow thickness dimension, the long width dimension providing stiffness in a first direction parallel the long width dimension to support at least part of a weight of the seating unit and the narrow thickness dimension providing flexibility in a second direction parallel the narrow thickness dimension, whereby a weight of the seated user is structurally supported and also operably supported for movement relative to the base.

30. The seating unit defined in claim 22, wherein said first flexible support has a cross section that is elongated and that changes in width along a length of the first flexible support.

31. The seating unit defined in claim 22, wherein said base includes side supports, and wherein said central component is positioned at least partially between the side supports.

32. A seating unit comprising:

a base;

a seat configured and adapted to support a seated user;

a polymeric frame component fixedly attached to and forming a structural part of at least one of the base and the seat; and at least one elongated flexible support having a cross section elongated so that the flexible support is flexible in a first direction but relatively rigid in a second direction perpendicular to the first direction, the at least one flexible support and the polymeric frame component being molded of plastic as a single integral part, with the at least one flexible support being configured to and supporting the seat for fore-aft movement generally parallel the first direction relative to the base.

* * * * *